US011643604B2

(12) United States Patent
Anguiano et al.

(10) Patent No.: US 11,643,604 B2
(45) Date of Patent: May 9, 2023

(54) HYDROCARBON GAS PROCESSING

(71) Applicant: UOP LLC, Des Plaines, IL (US)

(72) Inventors: J. Ascencion Anguiano, Midland, TX (US); John D. Wilkinson, Midland, TX (US); Scott A. Miller, Midland, TX (US); Stephen N. Peterson, Midland, TX (US); Daryl R. Jensen, Midland, TX (US); Michael C. Pierce, Midland, TX (US); Hank M. Hudson, Midland, TX (US)

(73) Assignee: UOP LLC, Des Plaines, IL (US)

( * ) Notice: Subject to any disclaimer, the term of this patent is extended or adjusted under 35 U.S.C. 154(b) by 70 days.

(21) Appl. No.: 17/072,731

(22) Filed: Oct. 16, 2020

(65) Prior Publication Data

US 2021/0115338 A1 Apr. 22, 2021

Related U.S. Application Data

(60) Provisional application No. 62/923,075, filed on Oct. 18, 2019.

(51) Int. Cl.
*F25J 3/02* (2006.01)
*C10G 5/06* (2006.01)

(52) U.S. Cl.
CPC ..... *C10G 5/06* (2013.01); *F25J 3/0233* (2013.01); *F25J 3/0238* (2013.01); *F25J 3/0242* (2013.01); *F25J 2200/02* (2013.01); *F25J 2200/94* (2013.01); *F25J 2205/10* (2013.01); *F25J 2280/02* (2013.01)

(58) Field of Classification Search
CPC ..... F25J 3/0233; F25J 3/0242; F25J 3/0209; F25J 3/0238; F25J 2200/94; F25J 2290/34
See application file for complete search history.

(56) References Cited

U.S. PATENT DOCUMENTS 3,292,380 A 12/1966 Bucklin
4,061,481 A 12/1977 Campbell et al.
4,140,504 A 2/1979 Campell et al.
(Continued)

OTHER PUBLICATIONS

Mowry, E. Ross, Efficient, High Recovery of Liquids From Natural Gas Utilizing a High Pressure Absorber, Eighty-First Annual Convention Proceedings of Gas Processors Association, 2002.

*Primary Examiner* — Brian M King
(74) *Attorney, Agent, or Firm* — Paschall & Associates, LLC; Mark Goldberg

(57) ABSTRACT

A process and an apparatus are disclosed for the recovery of components from a hydrocarbon gas stream containing significant quantities of components more volatile than methane (hydrogen, nitrogen, etc.). The gas stream is partially condensed, then the remaining vapor is expanded to lower pressure and supplied to a fractionation tower at a mid-column feed position. The condensed liquid is cooled and divided into two portions. The first portion is expanded to tower pressure, heated by cooling the liquid, and supplied to the tower at a lower column feed position. The second portion is further cooled, expanded to tower pressure, and supplied to the tower at a top feed position. The tower overhead vapor is heated by cooling the second portion. The quantities and temperatures of the feeds to the tower maintain the overhead temperature of the tower whereby the major portion of the desired components is recovered.

4 Claims, 5 Drawing Sheets

(56) References Cited

U.S. PATENT DOCUMENTS 4,157,904 A 6/1979 Campell et al.
4,171,964 A * 10/1979 Campbell ..... F25J 3/0219 62/621
4,185,978 A 1/1980 McGalliard et al.
4,251,249 A 2/1981 Gulsby
4,278,457 A 7/1981 Campbell et al.
4,519,824 A 5/1985 Huebel
4,617,039 A 10/1986 Buck
4,687,499 A 8/1987 Aghill
4,689,063 A 8/1987 Paradowski et al.
4,690,702 A 9/1987 Paradowski et al.
4,854,955 A 8/1989 Campbell et al.
4,869,740 A 9/1989 Campbell et al.
4,889,545 A 12/1989 Campbell et al.
RE33,408 E 10/1990 Khan et al.
5,275,005 A 1/1994 Campbell et al.
5,555,748 A 9/1996 Campbell et al.
5,566,554 A 10/1996 Vijayaraghavan et al.
5,568,737 A 10/1996 Campbell et al.
5,771,712 A 6/1998 Campbell et al.
5,799,507 A 9/1998 Wilkinson et al.
5,881,569 A 3/1999 Campbell et al.
5,890,378 A 4/1999 Rambo et al.
5,983,664 A 11/1999 Campbell et al.
6,182,469 B1 * 2/2001 Campbell ..... F25J 3/0219 62/621
6,578,379 B2 6/2003 Paradowski
6,712,880 B2 3/2004 Foglietta et al.
6,915,662 B2 7/2005 Wilkinson et al.
7,191,617 B2 3/2007 Cuellar et al.
7,219,513 B1 5/2007 Mostafa
8,590,340 B2 11/2013 Pitman et al.
8,881,549 B2 11/2014 Johnke et al.
8,919,148 B2 12/2014 Wilkinson et al.
9,021,831 B2 5/2015 Johnke et al.
9,021,832 B2 5/2015 Pierce et al.
9,052,136 B2 6/2015 Johnke et al.
9,052,137 B2 6/2015 Johnke et al.
9,057,558 B2 6/2015 Johnke et al.
9,068,774 B2 6/2015 Johnke et al.
9,074,814 B2 7/2015 Johnke et al.
9,080,810 B2 7/2015 Pitman et al.
9,080,811 B2 7/2015 Johnke et al.
9,476,639 B2 10/2016 Martinez et al.
9,637,428 B2 5/2017 Hudson et al.
9,783,470 B2 10/2017 Miller et al.
9,927,171 B2 3/2018 Hudson et al.
9,933,207 B2 4/2018 Johnke et al.
9,939,195 B2 4/2018 Johnke et al.
10,227,273 B2 3/2019 Miller et al.
10,533,794 B2 1/2020 Lynch et al.
10,551,118 B2 2/2020 Hudson et al.
10,551,119 B2 2/2020 Miller et al.
10,753,678 B2 8/2020 Pitman et al.
2008/0078205 A1 4/2008 Cuellar et al.
2011/0067441 A1 3/2011 Martinez et al.
2011/0067443 A1 3/2011 Martinez et al.
2016/0069610 A1 * 3/2016 Anguiano ..... F25J 3/0238 62/621
2016/0377341 A1 12/2016 Martinez et al.
2018/0347898 A1 12/2018 Pierce et al.
2018/0347899 A1 12/2018 Cuellar et al.
2019/0170435 A1 6/2019 Anguiano et al.
2020/0292230 A1 9/2020 Anguiano et al.

* cited by examiner

HYDROCARBON GAS PROCESSING

This invention relates to a process and apparatus for the separation of a gas containing hydrocarbons and significant quantities of components more volatile than methane (e.g., hydrogen, nitrogen, etc.). The applicants claim the benefits under Title 35, United States Code, Section 119(e) of prior U.S. Provisional Application No. 62/923,075 which was filed on Oct. 18, 2019.

BACKGROUND OF THE INVENTION

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Hydrocarbon bearing gas often contains components more volatile than methane as well as unsaturated hydrocarbons (e.g., ethylene, propylene, etc.) in addition to methane, ethane and hydrocarbons of higher molecular weight such as propane, butane, and pentane.

The present invention is generally concerned with improving the recovery of ethylene, ethane, propylene, propane, and heavier hydrocarbons from such gas streams. A typical analysis of a gas stream to be processed in accordance with this invention would be, in approximate mole percent, 42.4% methane, 22.8% ethane and other $C_2$ components, 7.6% propane and other $C_3$ components, 3.1% iso-butane, 2.7% normal butane, and 2.7% pentanes plus, with the balance made up of hydrogen, nitrogen, carbon monoxide, and carbon dioxide. Sulfur-containing gases are also sometimes present.

Recent changes in ethylene demand have created increased markets for ethylene and derivative products. In addition, fluctuations in the prices of both natural gas and its natural gas liquid (NGL) constituents have increased the incremental value of ethane, ethylene, propane, propylene, and heavier components as liquid products. These market conditions have resulted in a demand for processes that can provide high recoveries and more efficient recoveries of these products, and for processes that can provide efficient recoveries with lower capital investment. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; 8,590,340; 8,881,549; 8,919,148; 9,021,831; 9,021,832; 9,052,136; 9,052,137; 9,057,558; 9,068,774; 9,074,814; 9,080,810; 9,080,811; 9,476,639; 9,637,428; 9,783,470; 9,927,171; 9,933,207; 9,939,195; 10,227,273; 10,553,794; 10,551,118; 10,551,119; and 10,753,678; reissue U.S. Pat. No. 33,408; published US applications US20080078205A1; US20110067441A1; US20110067443A1; US2016/0069610A1; US2016/0377341A1; US 2018-0347898 A1; US2018/0347899A1; US 2019/0170435A1; and US 2020/0292230A1 describe relevant processes (although the description of the present invention in some cases is based on different processing conditions than those described in the cited U.S. patents and co-pending applications).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high-pressure liquids prior to the expansion may be desirable in order to further lower the temperature resulting from the expansion. The expanded stream, comprising a mixture of liquid and vapor, is fractionated in a distillation (demethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product.

If the feed gas is not totally condensed (typically it is not), the vapor remaining from the partial condensation can be passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

In the ideal operation of such a separation process, the residue gas leaving the process will contain substantially all of the methane and more volatile components in the feed gas with essentially none of the heavier hydrocarbon components and the bottoms fraction leaving the demethanizer will contain substantially all of the heavier hydrocarbon components with essentially no methane or more volatile components. In practice, however, this ideal situation is not obtained because the conventional demethanizer is operated largely as a stripping column. The residue gas from the process, therefore, typically comprises vapors leaving the top fractionation stage of the column, together with vapors not subjected to any rectification step. Considerable losses of $C_2$, $C_3$, and $C_4$+ components occur because the top liquid feed contains substantial quantities of these components and heavier hydrocarbon components, resulting in corresponding equilibrium quantities of $C_2$ components, $C_3$ components, $C_4$ components, and heavier hydrocarbon components in the vapors leaving the top fractionation stage of the demethanizer. This problem is exacerbated if the gas stream (s) being processed contain relatively large quantities of components more volatile than methane (e.g., hydrogen, nitrogen, etc.), because the volatile vapors rising up the column strip $C_2$+ components from the liquids flowing downward. The loss of these desirable $C_2$+ components could be significantly reduced if the rising vapors could be brought into contact with a significant quantity of liquid (reflux) capable of absorbing the $C_2$ components, $C_3$ components, $C_4$ components, and heavier hydrocarbon components from the vapors.

In recent years, the preferred processes for hydrocarbon separation use an upper absorber section to provide additional rectification of the rising vapors. For many of these processes, a portion of the vapor remaining from the partial condensation of the feed gas is cooled to substantial condensation by heat exchange with other process streams, e.g., the cold fractionation tower overhead. Some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the flash expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed. Unfortunately, this feed stream is not very effective at capturing the desired $C_2$+ components when the feed gas contains significant quantities of components more volatile than methane because the stream cannot be substantially condensed. This results in large amounts of flash vapor in the stream, which carries away equilibrium quantities of the $C_2$+ components rather than recovering them in the column.

Many processes combine this condensed flash expanded stream with another source of top reflux to the column. The source of this reflux stream is a recycled stream of residue gas supplied under pressure. The recycled residue gas stream is usually cooled to substantial condensation by heat exchange with other process streams, e.g., the cold fractionation tower overhead. The resulting substantially condensed stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typical process schemes of this type are disclosed in U.S. Pat. Nos. 4,889,545; 5,568,737; 5,881,569; 9,052,137; and 9,080,811, and in Mowrey, E. Ross, "Efficient, High Recovery of Liquids from Natural Gas Utilizing a High Pressure Absorber", Proceedings of the Eighty-First Annual Convention of the Gas Processors Association, Dallas, Tex., Mar. 11-13, 2002. Unfortunately, this method is not efficient when the residue gas contains significant quantities of components more volatile than methane because the recycle stream cannot be cooled to substantial condensation.

Another means of providing a reflux stream for the upper rectification section is to withdraw a distillation vapor stream from a lower location on the tower (and perhaps combine it with a portion of the tower overhead vapor). This vapor (or combined vapor) stream is compressed to higher pressure, then cooled to substantial condensation, expanded to the tower operating pressure, and supplied as top feed to the tower. Typical process schemes of this type are disclosed in U.S. Pat. Nos. 5,275,005 and 9,476,639 and in published application nos. US 2008-0078205 A1 and US 2011-0067443 A1. However, this stream is generally not sufficient to provide the desired rectification by itself and combining it with the condensed flash expanded stream described earlier is not effective when there is a significant quantity of components more volatile than methane in the feed gas.

The present invention also employs an upper rectification section (or a separate rectification column in some embodiments). However, the reflux for this upper rectification section is provided by cooling a liquid stream derived from the feed gas and then expanding the stream to the operating pressure of the fractionation tower. During expansion, a portion of the stream is vaporized, resulting in cooling of the total stream. The cooled, expanded stream is supplied to the tower at the top column feed point, where it can then be used to absorb $C_2$ components, $C_3$ components, $C_4$ components, and heavier hydrocarbon components from the vapors rising through the rectification section and thereby capture these valuable components in the bottom liquid product from the demethanizer. Surprisingly, the present invention can achieve high recovery without using a second reflux stream that is predominantly methane as required in some of the prior art. This eliminates the reflux compressor used in that prior art, reducing capital cost and operating cost compared to that prior art.

In accordance with the present invention, it has been found that $C_2$ component recovery in excess of 95% and $C_3$ component and $C_4$+ component recoveries in excess of 99% can be obtained. In addition, the present invention makes possible essentially 100% separation of methane and lighter components from the $C_2$ components and heavier components at the same energy requirements compared to the prior art while increasing the recovery level. The present invention is particularly advantageous when processing feed gases that contain more than 10 mole % of components more volatile than methane (e.g., hydrogen, nitrogen, etc.).

For a better understanding of the present invention, reference is made to the following examples and drawings. Referring to the drawings:

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

Figure 1:
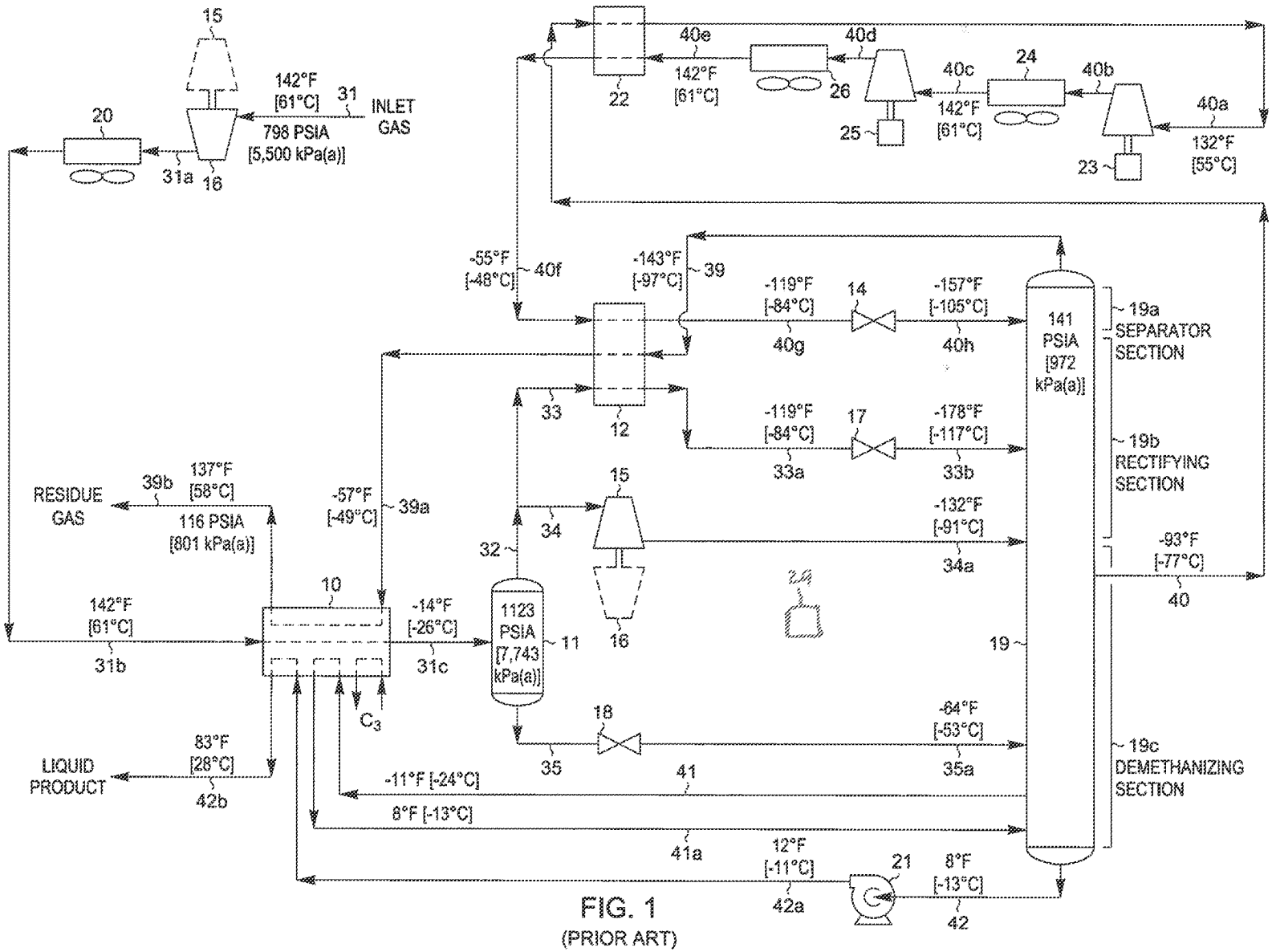
FIG. 1 (PRIOR ART)
FIG. 1 is a flow diagram of a prior art gas processing plant in accordance with co-pending application Ser. No. 11/839,693.

FIG. 1 is a process flow diagram showing the design of a processing plant to recover $C_2$+ components from a gas stream using prior art according to co-pending application US 2008-0078205 A1. In this simulation of the process, inlet gas enters the plant at 142° F. [61° C.] and 798 psia [5,500 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 enters compressor 16 driven by expansion machine 15 and is boosted to higher pressure. After cooling to 142° F. [61° C.] in cooler 20, stream 31*b* at 1146 psia [7,901 kPa(a)] is cooled in heat exchanger 10 by heat exchange with cool residue gas (stream 39*a*) at −57° F. [−49° C.], pumped liquid product (stream 42*a*) at 12° F. [−11° C.], demethanizer reboiler liquids (stream 41) at −11° F. [−24° C.], and propane refrigerant. Note that in all cases exchanger 10 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 31*c* enters separator 11 at −14° F. [−26° C.] and 1123 psia [7,743 kPa(a)] where the vapor (stream 32) is separated from the condensed liquid (stream 35). The separator liquid (stream 35) is expanded to the operating pressure (approximately 141 psia [972 kPa(a)]) of fractionation tower 19 by expansion valve 18, cooling stream 35*a* to −64° F. [−53° C.] before it is supplied to fractionation tower 19 at a lower mid-column feed point.

The vapor (stream 32) from separator 11 is divided into two streams, 33 and 34. Stream 33, containing about 5% of the total vapor, passes through heat exchanger 12 in heat exchange relation with cold distillation stream 39 at −143° F. [−97° C.] where it is cooled to substantial condensation. The resulting substantially condensed stream 33*a* at −119° F. [−84° C.] is then flash expanded through an appropriate expansion device, such as expansion valve 17, to the operating pressure of fractionation tower 19. During expansion a portion of the stream is vaporized, resulting in cooling of the total stream. In the process illustrated in FIG. 1, the expanded stream 33*b* leaving expansion valve 17 reaches a temperature of −178° F. [−117° C.] and is supplied to fractionation tower 19 at an upper mid-column feed point.

The remaining vapor from separator 11 (stream 34) enters work expansion machine 15 in which mechanical energy is extracted from this portion of the high pressure feed. The machine 15 expands the vapor substantially isentropically to the tower operating pressure, with the work expansion cooling the expanded stream 34*a* to a temperature of approximately −132° F. [−91° C.]. The typical commercially available expanders are capable of recovering on the order of 80-85% of the work theoretically available in an ideal isentropic expansion. The work recovered is often used to drive a centrifugal compressor (such as item 16) that can be used to compress the feed gas (stream 31), for example. The partially condensed expanded stream 34*a* is thereafter supplied as feed to fractionation tower 19 at a mid-column feed point.

The demethanizer in tower 19 is a conventional distillation column containing a plurality of vertically spaced trays, one or more packed beds, or some combination of trays and packing. As is often the case in gas processing plants, the fractionation tower may consist of three sections. The upper section 19*a* is a separator wherein the partially vaporized top feed is divided into its respective vapor and liquid portions, and wherein the vapor rising from the middle absorbing (rectifying) section 19*b* is combined with the vapor portion of the top feed to form the cold demethanizer overhead vapor (stream 39) which exits the top of the tower at −143° F. [−97° C.]. The lower stripping (demethanizing) section 19*c* contains the trays and/or packing and provides the necessary contact between the liquids falling downward and the vapors rising upward. The demethanizing section 19*c* also includes reboilers (such as the reboiler described previously) which heat and vaporize a portion of the liquids flowing down the column to provide the stripping vapors which flow up the column to strip the liquid product, stream 42, of methane and lighter components. Stream 34*a* enters demethanizer 19 at an intermediate feed position located in the lower region of rectifying section 19*b* of demethanizer 19. The liquid portion of the expanded stream commingles with liquids falling downward from rectifying section 19*b* and the combined liquid continues downward into demethanizing section 19*c* of demethanizer 19. The vapor portion of the expanded stream commingles with vapors arising from demethanizing section 19*c* and the combined vapor rises upward through rectifying section 19*b* and is contacted with cold liquid falling downward to condense and absorb the $C_2$ components, $C_3$ components, and heavier components.

A portion of the distillation vapor (stream 40) is withdrawn from an upper region of demethanizing section 19*c* in fractionation column 19, below the feed position of expanded stream 34*a* in the lower region of rectifying section 19*b*. The distillation vapor stream 40 at −93° F. [−77° C.] is heated to 132° F. [55° C.] in heat exchanger 22 as it cools compressed stream 40*e*. Heated stream 40*a* is compressed to 412 psia [2,839 kPa(a)] (stream 40*d*) in two stages by reflux compressors 23 and 25, with cooling to 142° F. [61° C.] after each stage in coolers 24 and 26. The cooled compressed stream 40*e* is cooled to −55° F. [−48° C.] (stream 40*f*) in heat exchanger 22 as described earlier, then further cooled to −119° F. [−84° C.] and substantially condensed (stream 40*g*) in heat exchanger 12 by heat exchange with cold demethanizer overhead stream 39 as described previously. The cold residue gas stream is warmed (stream 39*a*) as it provides cooling to compressed distillation vapor stream 40*f*.

The substantially condensed stream 40*g* is flash expanded to the operating pressure of demethanizer 19 by expansion valve 14. A portion of the stream is vaporized, further cooling stream 40*h* to −157° F. [−105° C.] before it is supplied as cold top column feed (reflux) to separator section 19*a* in the upper region of fractionation tower 19.

The liquids separated therein become the top feed to rectifying section 19*b* and the cold liquid reflux absorbs and condenses the $C_2$ components, $C_3$ components, and heavier components rising in the upper region of rectifying section 19*b* of demethanizer 19.

Liquid product stream 42 exits the bottom of the tower at 8° F. [−13° C.], based on a typical specification of a methane to ethane ratio of 0.010:1 on a molar basis in the bottom product. It is pumped to a pressure of approximately 455 psia [3,135 kPa(a)] in demethanizer bottoms pump 21, and the pumped liquid product is then warmed to 83° F. [28° C.] as it provides cooling of stream 31*b* in exchanger 10 before flowing to storage.

The residue gas (demethanizer overhead vapor stream 39) passes countercurrently to the incoming feed gas in heat exchanger 12 where it is heated to −57° F. [−49° C.] (stream 39*a*) and in heat exchanger 10 where it is heated to 137° F. [58° C.] (stream 39*b*). The residue gas product (stream 39*b*) then flows to the fuel gas system at 116 psia [801 kPa(a)].

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Hydrogen | Methane | $C_2$ Comp. | $C_3$ Comp. | $C_4$+ Comp. | Total |
|---|---|---|---|---|---|---|
| 31 | 1,998 | 4,661 | 2,505 | 839 | 939 | 10,980 |
| 32 | 1,834 | 2,994 | 664 | 85 | 31 | 5,640 |
| 35 | 164 | 1,667 | 1,841 | 754 | 908 | 5,340 |
| 33 | 92 | 150 | 33 | 4 | 2 | 282 |
| 34 | 1,742 | 2,844 | 631 | 81 | 29 | 5,358 |
| 40 | 125 | 1,373 | 467 | 6 | 0 | 1,976 |
| 39 | 1,998 | 4,640 | 459 | 0 | 0 | 7,136 |
| 42 | 0 | 21 | 2,046 | 839 | 939 | 3,844 |

| Recoveries* | |
|---|---|
| $C_2$ Components | 81.68% |
| $C_3$ Components | 99.95% |
| $C_4$+ Components | 100.00% |

| Power | | |
|---|---|---|
| Reflux Compression | 1,687 HP | [2,773 kW] |
| Refrigerant Compression | 2,921 HP | [4,802 kW] |
| Total Compression | 4,608 HP | [7,575 kW] |

*(Based on un-rounded flow rates)

Figure 2:
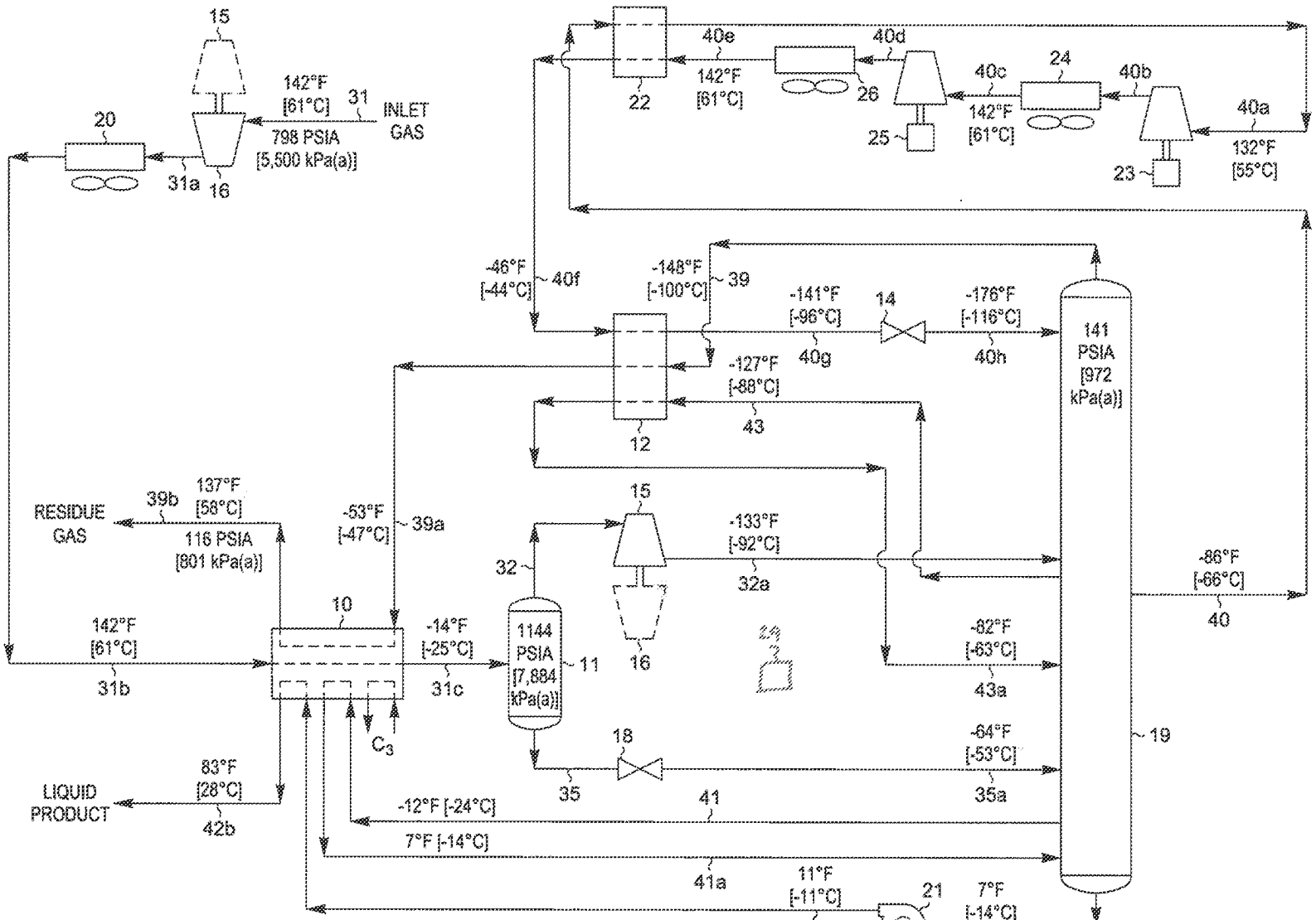
FIG. 2 (PRIOR ART)
FIG. 2 is a flow diagram of a prior art gas processing plant in accordance with U.S. Pat. No. 5,275,005.

FIG. 2 represents an alternative prior art process in accordance with U.S. Pat. No. 5,275,005. The process of FIG. 2 has been applied to the same feed gas composition and conditions as described above for FIG. 1. Accordingly, the FIG. 2 process can be compared with that of the FIG. 1 process.

The feed stream 31 enters compressor 16 driven by expansion machine 15 and is boosted to higher pressure. After cooling to 142° F. [61° C.] in cooler 20, stream 31*b* at 1166 psia [8,042 kPa(a)] is cooled in heat exchanger 10 by heat exchange with cool residue gas (stream 39*a*) at −53° F. [−47° C.], pumped liquid product (stream 42*a*) at 11° F. [−11° C.], demethanizer reboiler liquids (stream 41) at −12° F. [−24° C.], and propane refrigerant. The cooled stream 31*c* enters separator 11 at −14° F. [−25° C.] and 1144 psia [7,884 kPa(a)] where the vapor (stream 32) is separated from the condensed liquid (stream 35). The separator liquid (stream 35) is expanded to the operating pressure (approximately 141 psia [972 kPa(a)]) of fractionation tower 19 by expansion valve 18, cooling stream 35*a* to −64° F. [−53° C.] before it is supplied to fractionation tower 19 at a lower mid-column feed point.

The vapor (stream 32) from separator 11 enters work expansion machine 15 in which mechanical energy is extracted from this portion of the high pressure feed. The machine 15 expands the vapor substantially isentropically to the tower operating pressure, with the work expansion cooling the expanded stream 32*a* to a temperature of approximately −133° F. [−92° C.]. The partially condensed expanded stream 32*a* is thereafter supplied as feed to fractionation tower 19 at a mid-column feed point.

A portion of the distillation vapor (stream 40) is withdrawn from an intermediate region of fractionation column 19, below the feed position of expanded stream 32*a*. The distillation vapor stream 40 at −86° F. [−66° C.] is heated to 132° F. [55° C.] in heat exchanger 22 as it cools compressed stream 40*e*. Heated stream 40*a* is compressed to 411 psia [2,836 kPa(a)] (stream 40*d*) in two stages by reflux compressors 23 and 25, with cooling to 142° F. [61° C.] after each stage in coolers 24 and 26. The cooled compressed stream 40*e* is cooled to −46° F. [−44° C.] (stream 40*f*) in heat exchanger 22 as described earlier, then further cooled to −141° F. [−96° C.] and substantially condensed (stream 40*g*) in heat exchanger 12 by heat exchange with cold demethanizer overhead stream 39 as described previously and with distillation liquid stream 43 at −127° F. [−88° C.] which is withdrawn from a region of demethanizer 19 immediately below the feed point of expanded stream 32*a*. The cold residue gas stream and the distillation liquid stream are warmed as they provide cooling to compressed distillation vapor stream 40*f*, and the warmed distillation liquid stream 43*a* returns to demethanizer 19 at −82° F. [−63° C.].

The substantially condensed stream 40*g* is flash expanded to the operating pressure of demethanizer 19 by expansion valve 14. A portion of the stream is vaporized, further cooling stream 40*h* to −176° F. [−116° C.] before it is supplied as cold top column feed (reflux) to fractionation tower 19. The cold liquid reflux absorbs and condenses the $C_2$ components, $C_3$ components, and heavier components rising in the upper region of demethanizer 19.

Liquid product stream 42 exits the bottom of the tower at 7° F. [−14° C.], based on a typical specification of a methane to ethane ratio of 0.010:1 on a molar basis in the bottom product. It is pumped to a pressure of approximately 455 psia [3,135 kPa(a)] in demethanizer bottoms pump 21, and the pumped liquid product is then warmed to 83° F. [28° C.] as it provides cooling of stream 31*b* in exchanger 10 before flowing to storage.

The residue gas (demethanizer overhead vapor stream 39) passes countercurrently to cooled compressed distillation vapor stream 40*f* in heat exchanger 12 where it is heated to −53° F. [−47° C.] (stream 39*a*), and to the incoming feed gas in heat exchanger 10 where it is heated to 137° F. [58° C.] (stream 39*b*). The residue gas product (stream 39*b*) then flows to the fuel gas system at 116 psia [801 kPa(a)].

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Hydrogen | Methane | $C_2$ Comp. | $C_3$ Comp. | $C_4$+ Comp. | Total |
|---|---|---|---|---|---|---|
| 31 | 1,998 | 4,661 | 2,505 | 839 | 939 | 10,980 |
| 32 | 1,827 | 2,963 | 655 | 85 | 31 | 5,592 |
| 35 | 171 | 1,698 | 1,850 | 754 | 908 | 5,388 |
| 40 | 118 | 1,288 | 559 | 7 | 0 | 1,976 |
| 43 | 2 | 226 | 1,099 | 94 | 32 | 1,454 |
| 39 | 1,998 | 4,640 | 381 | 0 | 0 | 7,056 |
| 42 | 0 | 21 | 2,124 | 839 | 939 | 3,924 |

| Recoveries* | |
|---|---|
| $C_2$ Components | 84.81% |
| $C_3$ Components | 99.97% |
| $C_4$+ Components | 100.00% |

| Power | | |
|---|---|---|
| Reflux Compression | 1,682 HP | [2,765 kW] |
| Refrigerant Compression | 2,930 HP | [4,817 kW] |
| Total Compression | 4,612 HP | [7,582 kW] |

*(Based on un-rounded flow rates)

A comparison of Tables I and II shows that, compared to the FIG. 1 process, the FIG. 2 process improves $C_2$ component recovery from 81.68% to 84.81% and $C_3$ component recovery from 99.95% to 99.97%, and the $C_4$+ component recovery remains the same at 100.00%. Comparison of Tables I and II further shows that these increased product yields were achieved without using additional power.

Figure 3:
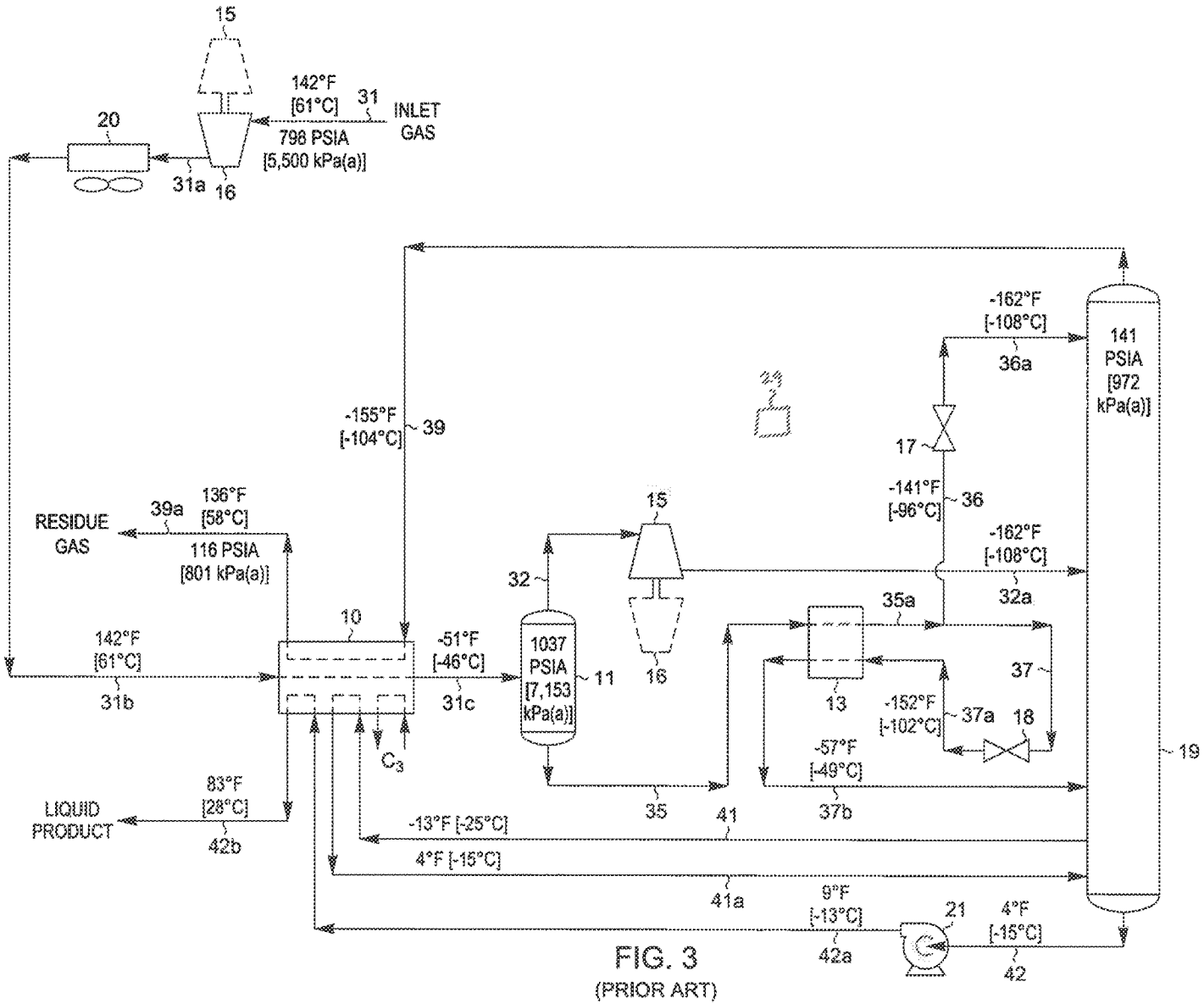
FIG. 3 (PRIOR ART)
FIG. 3 is a flow diagram of a prior art gas processing plant in accordance with U.S. Pat. No. 4,171,964.

FIG. 3 represents another alternative prior art process in accordance with U.S. Pat. No. 4,171,964. The process of FIG. 3 has been applied to the same feed gas composition and conditions as described above for FIG. 1 and FIG. 2. Accordingly, the FIG. 3 process can be compared with that of the FIG. 1 and FIG. 2 processes.

The feed stream 31 enters compressor 16 driven by expansion machine 15 and is boosted to higher pressure. After cooling to 142° F. [61° C.] in cooler 20, stream 31*b* at 1060 psia [7,311 kPa(a)] is cooled in heat exchanger 10 by heat exchange with cold residue gas (stream 39) at −155° F. [−104° C.], pumped liquid product (stream 42*a*) at 9° F. [−13° C.], demethanizer reboiler liquids (stream 41) at −13° F. [−25° C.], and propane refrigerant. The cooled stream 31*c* enters separator 11 at −51° F. [−46° C.] and 1037 psia [7,153 kPa(a)] where the vapor (stream 32) is separated from the condensed liquid (stream 35).

The vapor (stream 32) from separator 11 enters work expansion machine 15 in which mechanical energy is extracted from this portion of the high pressure feed. The machine 15 expands the vapor substantially isentropically to the operating pressure (approximately 141 psia [972 kPa (a)]) of fractionation tower 19, with the work expansion cooling the expanded stream 32*a* to a temperature of approximately −162° F. [−108° C.]. The partially condensed expanded stream 32*a* is thereafter supplied as feed to fractionation tower 19 at a mid-column feed point.

The separator liquid (stream 35) is cooled to −141° F. [−96° C.] in heat exchanger 13, and cooled liquid stream 35*a* is then divided into two streams, stream 36 and stream 37. Stream 37 is expanded to slightly above the operating pressure of fractionation tower 19 by expansion valve 18, cooling stream 37*a* to −152° F. [−102° C.] before it is heated as it supplies the cooling in heat exchanger 13. The warmed stream 37*b* at −57° F. [−49° C.] is then supplied to fractionation tower 19 at a lower mid-column feed point.

The remaining portion of cooled liquid stream 35*a*, stream 36, is flash expanded to the operating pressure of demethanizer 19 by expansion valve 17. A portion of the stream is vaporized, further cooling stream 36*a* to −162° F. [−108° C.] before it is supplied as cold top column feed (reflux) to fractionation tower 19. The cold liquid reflux absorbs and condenses the $C_2$ components, $C_3$ components, and heavier components rising in the upper region of demethanizer 19.

Liquid product stream 42 exits the bottom of the tower at 4° F. [−15° C.], based on a typical specification of a methane to ethane ratio of 0.010:1 on a molar basis in the bottom product. It is pumped to a pressure of approximately 455 psia [3,135 kPa(a)] in demethanizer bottoms pump 21, and the pumped liquid product is then warmed to 83° F. [28° C.] as it provides cooling of stream 31*b* in exchanger 10 before flowing to storage.

The residue gas (demethanizer overhead vapor stream 39) passes countercurrently to the incoming feed gas in heat exchanger 10 where it is heated to 136° F. [58° C.] (stream 39*a*). The residue gas product (stream 39*a*) then flows to the fuel gas system at 116 psia [801 kPa(a)].

A summary of stream flow rates and energy consumption for the process illustrated in FIG. 3 is set forth in the following table:

TABLE III (FIG. 3)
Stream Flow Summary - Lb. Moles/Hr [kg moles/Hr]

| Stream | Hydrogen | Methane | $C_2$ Comp. | $C_3$ Comp. | $C_4$+ Comp. | Total |
|---|---|---|---|---|---|---|
| 31 | 1,998 | 4,661 | 2,505 | 839 | 939 | 10,980 |
| 32 | 1,820 | 2,464 | 347 | 32 | 9 | 4,702 |
| 35 | 178 | 2,197 | 2,158 | 807 | 930 | 6,278 |
| 36 | 77 | 945 | 928 | 347 | 400 | 2,700 |
| 37 | 101 | 1,252 | 1,230 | 460 | 530 | 3,578 |
| 39 | 1,998 | 4,638 | 159 | 4 | 0 | 6,835 |
| 42 | 0 | 23 | 2,346 | 835 | 939 | 4,145 |

| Recoveries* | |
|---|---|
| $C_2$ Components | 93.68% |
| $C_3$ Components | 99.56% |
| $C_4$+ Components | 99.96% |

| Power | | |
|---|---|---|
| Refrigerant Compression | 4,608 HP | [7,575 kW] |
| Total Compression | 4,608 HP | [7,575 kW] |

*(Based on un-rounded flow rates)

A comparison of Tables II and III shows that, compared to the FIG. 2 process, the FIG. 3 process improves $C_2$ component recovery from 84.81% to 93.68%, but $C_3$ component recovery drops from 99.97% to 99.56% and $C_4$+ component recovery drops from 100.00% to 99.96%. Comparison of Tables II and III further shows that these product yields were achieved using the same power.

DESCRIPTION OF THE INVENTION

Figure 4:
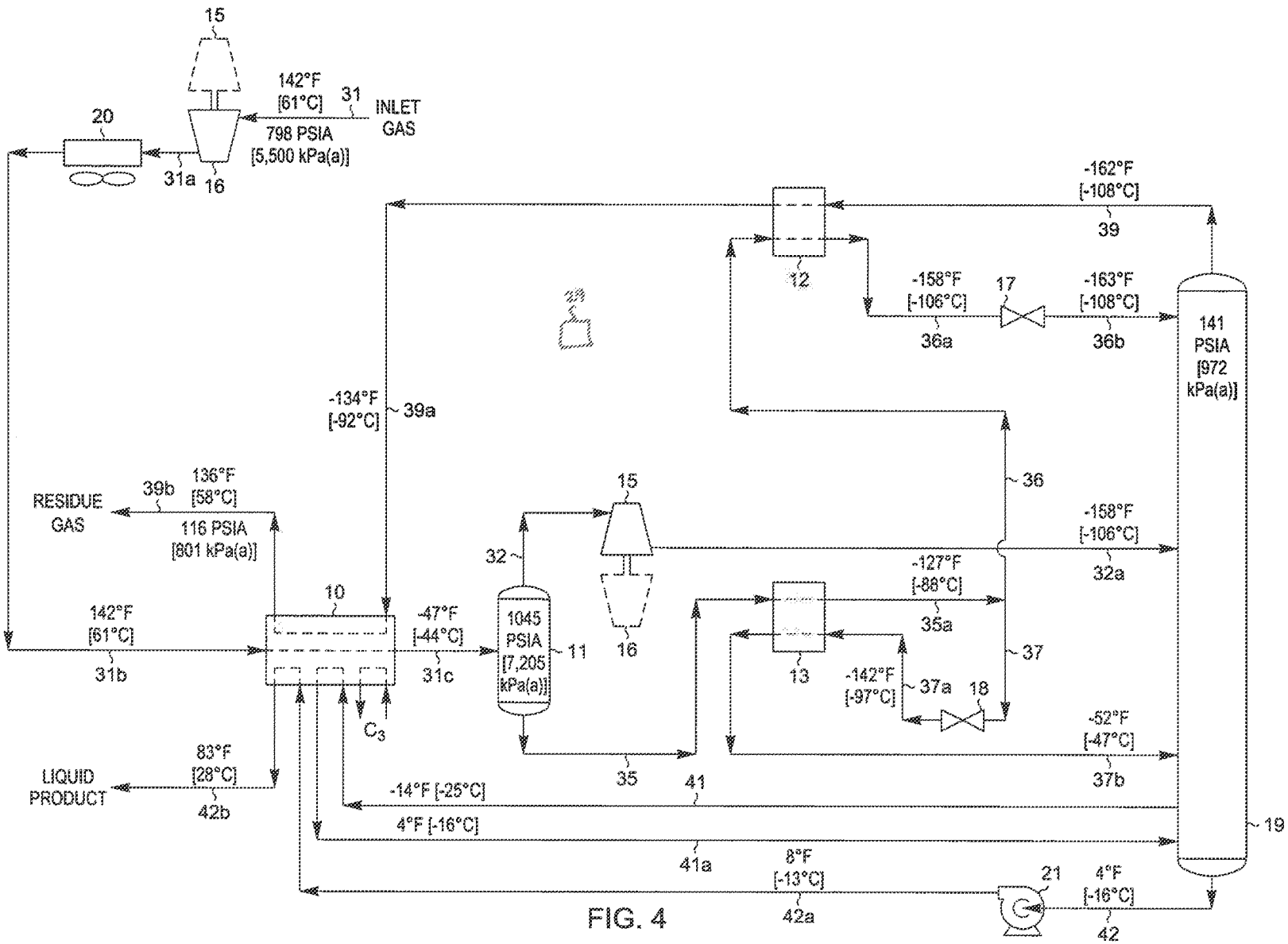
FIG. 4 is a flow diagram of a gas processing plant in accordance with the present invention.

FIG. 4 illustrates a flow diagram of a process in accordance with the present invention. The feed gas composition and conditions considered in the process presented in FIG. 4 are the same as those in FIGS. 1, 2, and 3. Accordingly, the FIG. 4 process can be compared with that of the FIGS. 1, 2, and 3 processes to illustrate the advantages of the present invention.

The feed stream 31 enters compressor 16 driven by expansion machine 15 and is boosted to higher pressure. After cooling to 142° F. [61° C.] in cooler 20, stream 31*b* at 1071 psia [7,384 kPa(a)] is cooled in heat exchanger 10 by heat exchange with cool residue gas (stream 39*a*) at −134° F. [−92° C.], pumped liquid product (stream 42*a*) at 8° F. [−13° C.], demethanizer reboiler liquids (stream 41) at −14° F. [−25° C.], and propane refrigerant. The cooled stream 31*c* enters separator 11 at −47° F. [−44° C.] and 1045 psia [7,205 kPa(a)] where the vapor (stream 32) is separated from the condensed liquid (stream 35).

The vapor (stream 32) from separator 11 enters work expansion machine 15 in which mechanical energy is extracted from this portion of the high pressure feed. The machine 15 expands the vapor substantially isentropically to the operating pressure (approximately 141 psia [972 kPa (a)]) of fractionation tower 19, with the work expansion cooling the expanded stream 32*a* to a temperature of approximately −158° F. [−106° C.]. The partially condensed expanded stream 32*a* is thereafter supplied as feed to fractionation tower 19 at a mid-column feed point below the rectifying section and above the demethanizing section in fractionation tower 19.

The separator liquid (stream 35) is cooled to −127° F. [−88° C.] in heat exchanger 13, and cooled liquid stream 35*a* is then divided into two streams, stream 36 and stream 37. Stream 37 is expanded to slightly above the operating pressure of fractionation tower 19 by expansion valve 18, cooling stream 37*a* to −142° F. [−97° C.] before it is heated as it supplies the cooling in heat exchanger 13. The warmed stream 37*b* at −52° F. [−47° C.] is then supplied to fractionation tower 19 at a lower mid-column feed point.

The remaining portion of cooled liquid stream 35*a*, stream 36, passes through heat exchanger 12 in heat exchange relation with cold distillation stream 39 at −162° F. [−108° C.] where it is further cooled to −158° F. [−106° C.]. The further cooled stream 36*a* then is flash expanded to the operating pressure of demethanizer 19 by expansion valve 17. A portion of the stream is vaporized, further cooling stream 36*b* to −163° F. [−108° C.] before it is supplied as cold top column feed (reflux) to the separator section in fractionation tower 19. The liquids separated therein become the top feed to the rectifying section in fractionation tower 19 and the cold liquid reflux absorbs and condenses the $C_2$ components, $C_3$ components, and heavier components rising in the rectifying section.

Liquid product stream 42 exits the bottom of the tower at 4° F. [−16° C.], based on a typical specification of a methane to ethane ratio of 0.010:1 on a molar basis in the bottom product. It is pumped to a pressure of approximately 455 psia [3,135 kPa(a)] in demethanizer bottoms pump 21, and the pumped liquid product is then warmed to 83° F. [28° C.] as it provides cooling of stream 31*b* in exchanger 10 before flowing to storage.

The residue gas (demethanizer overhead vapor stream 39) passes countercurrently to cooled liquid stream 36 in heat exchanger 12 where it is heated to −134° F. [−92° C.] (stream 39*a*), and to the incoming feed gas in heat exchanger 10 where it is heated to 136° F. [58° C.] (stream 39*b*). The residue gas product (stream 39*b*) then flows to the fuel gas system at 116 psia [801 kPa(a)].

A summary of stream flow rates and energy consumption for the process illustrated in FIG. 4 is set forth in the following table:

TABLE IV (FIG. 4)
Stream Flow Summary - Lb. Moles/Hr [kg moles/Hr]

| Stream | Hydrogen | Methane | $C_2$ Comp. | $C_3$ Comp. | $C_4$+ Comp. | Total |
|---|---|---|---|---|---|---|
| 31 | 1,998 | 4,661 | 2,505 | 839 | 939 | 10,980 |
| 32 | 1,822 | 2,531 | 377 | 36 | 11 | 4,805 |
| 35 | 176 | 2,130 | 2,128 | 803 | 928 | 6,175 |
| 36 | 83 | 1,001 | 1,000 | 377 | 436 | 2,902 |
| 37 | 93 | 1,129 | 1,128 | 426 | 492 | 3,273 |
| 39 | 1,998 | 4,637 | 119 | 3 | 0 | 6,793 |
| 42 | 0 | 24 | 2,386 | 836 | 939 | 4,187 |
| | Recoveries* | | | | | |
| | $C_2$ Components | | | 95.26% | | |
| | $C_3$ Components | | | 99.69% | | |
| | $C_4$+ Components | | | 99.98% | | |
| Power | | | | | | |
| Refrigerant Compression | | | 4,602 HP | | [7,566 kW] | |
| Total Compression | | | 4,602 HP | | [7,566 kW] | |

*(Based on un-rounded flow rates)

A comparison of Tables I, II, III, and IV shows that, compared to the prior art processes, the present invention significantly improves $C_2$ component recovery (from 81.68%, 84.81%, and 93.68%, respectively, to 95.26%) and maintains much the same $C_3$ component and $C_4$+ component recoveries. Comparison of Tables I, II, III, and IV further shows that these yields were achieved using slightly less power than the prior art processes. In terms of the recovery efficiency (defined by the quantity of ethane recovered per unit of power), the present invention represents a 17%, 13%, and 2% improvement, respectively, over the prior art of the FIG. 1, FIG. 2, and FIG. 3 processes.

The superior $C_2$ component recovery performance of the present invention compared to that of the prior art processes is most easily understood by examining the feed streams supplied to the rectifying section in demethanizer 19. As explained in the BACKGROUND OF THE INVENTION, the goal is to provide reflux stream(s) capable of capturing the desired $C_2$+ components rising from below (most of which originate in the expanded stream supplied to the mid-column feed point of demethanizer 19, stream 34*a* in FIG. 1, stream 32*a* in FIGS. 2, 3, and 4). This usually means reflux stream(s) that are predominantly methane, with low concentrations of $C_2$ components and heavier components.

The FIG. 1 process supplies two reflux streams to the rectifying section in demethanizer 19, stream 40*h* at the top and stream 33*b* at the mid-point. However, the flow rate of stream 33*b* is very low and it contains a significant concentration of components more volatile than methane, adding to the rectifying load for reflux stream 40*h*. This diminishes the effectiveness of stream 40*h*, resulting in low recovery of the $C_2$ components.

Both the FIG. 2 process and the FIG. 3 process supply only a single reflux stream to the rectifying section in demethanizer 19, stream 40*h* for FIG. 2 and stream 36*a* for FIG. 3. Counterintuitively, reflux stream 36*a* in FIG. 3 has much higher concentrations of $C_2$ components and $C_3$+ components than reflux stream 40*h* in FIG. 2, and yet it captures much more of the $C_2$ components. In the FIG. 3 case, the heavy components in reflux stream 36*a* help to capture the $C_2$ components by absorption, with the tradeoff that recovery of the $C_3$ components and $C_4$+ components drops somewhat due to equilibrium losses at the top of the column.

In the present invention in FIG. 4, reflux stream 36*b* is used as the top feed to the rectifying section similar to reflux stream 36*a* in the prior art FIG. 3 process. Comparison of Tables III and IV shows that the composition of reflux stream 36*a* in FIG. 3 is essentially the same as that of reflux stream 36*b* in FIG. 4, although the flow rate of the reflux stream in the FIG. 4 embodiment of the present invention is approximately 7% higher. However, the key difference in the present invention is the much greater degree of subcooling applied to reflux stream 36/36*a* upstream of expansion valve 17 in FIG. 4 (−158° F. [−106° C.]) versus that of reflux stream 36 in FIG. 3 (−141° F. [−96° C.]). While the temperature resulting after expansion (stream 36*a* in FIG. 3, stream 36*b* in FIG. 4) is essentially the same, the amount of flash vapor that results is significantly lower for the present invention in FIG. 4.

There are two benefits to reducing the amount of flash vapor when the reflux stream is expanded to the operating pressure of demethanizer 19. First, since the flash vapor leaves demethanizer 19 without being subjected to any rectification, this reduces the amount of $C_2$+ components lost in the flash gas. Second, the amount of liquid reflux remaining to flow to the rectifying section in demethanizer 19 is greater, allowing for better absorption of the $C_2$+ components and the correspondingly higher recoveries shown in Table IV versus Table III.

Other Embodiments

In accordance with this invention, it is generally advantageous to design the absorbing (rectifying) section of the demethanizer to contain multiple theoretical separation stages. However, the benefits of the present invention can be achieved with as few as one theoretical stage. For instance, all or a part of the expanded cooled liquid stream 36*b* from expansion valve 17 and at least a portion of expanded stream

32*a* can be combined (such as in the piping joining the expansion valve and the expansion machine to the demethanizer) and if thoroughly intermingled, the vapors and liquids will mix together and separate in accordance with the relative volatilities of the various components of the total combined streams. Such commingling of the two streams shall be considered for the purposes of this invention as constituting an absorbing section.

Figure 5:
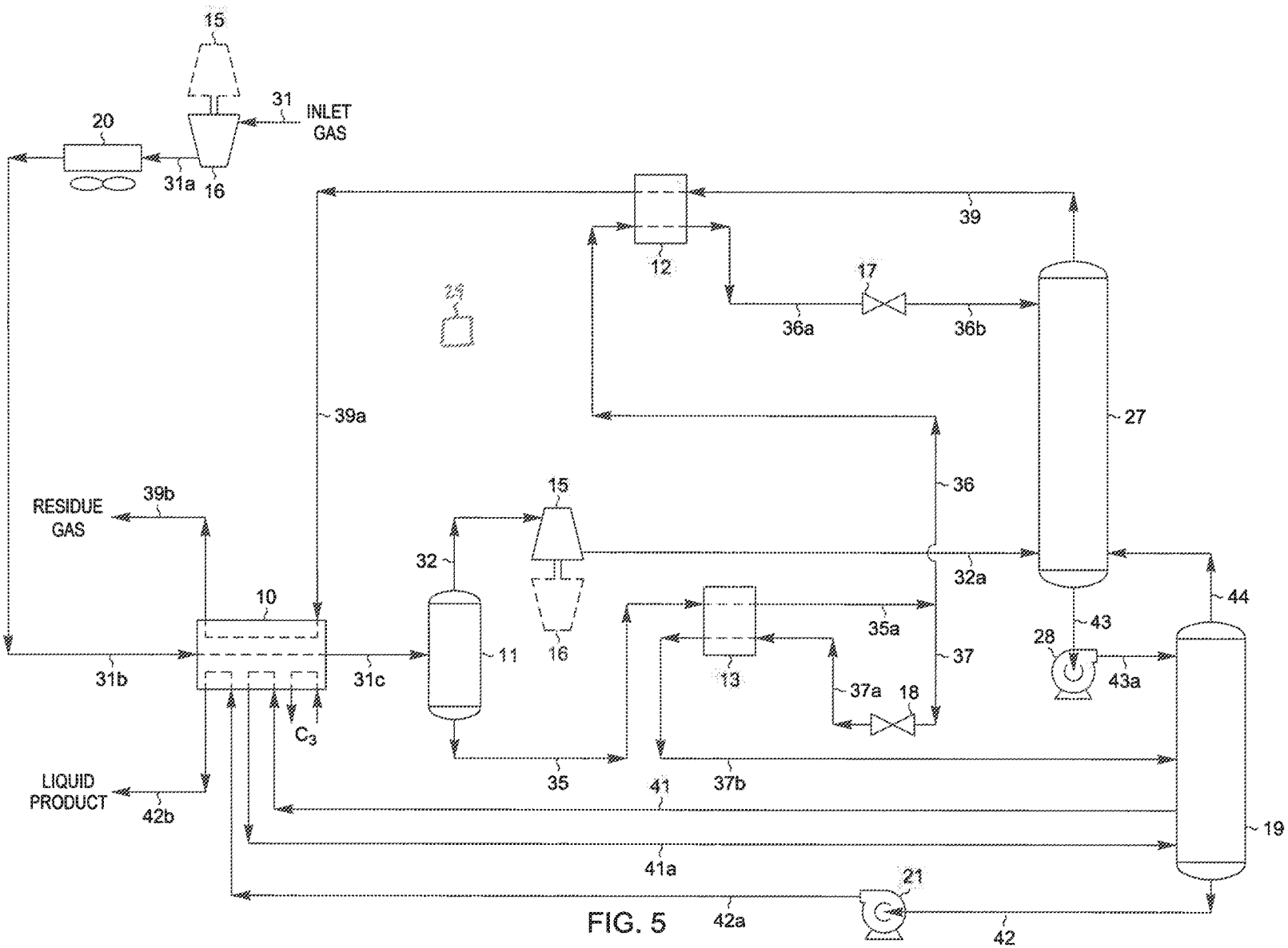
FIG. 5 is a flow diagram illustrating alternative means of application of the present invention to a gas stream.

FIG. 4 depicts the fractionation tower constructed in a single vessel. FIG. 5 displays another embodiment of the present invention. with the fractionation tower constructed in two vessels, absorber (rectifier) column 27 (a contacting and separating device) and stripper (distillation) column 19. In such cases, the overhead vapor stream 44 from stripper column 19 flows to the lower section of absorber column 27 to be contacted by expanded cooled liquid stream 36*b*. Pump 28 is used to route the liquids (stream 43) from the bottom of absorber column 27 to the top of stripper column 19 so that the two towers effectively function as one distillation system. The decision whether to construct the fractionation tower as a single vessel (such as demethanizer 19 in FIG. 4) or multiple vessels will depend on a number of factors such as plant size, the distance to fabrication facilities, etc.

The present invention provides improved recovery of $C_2$ components per amount of utility consumption required to operate the process. An improvement may also be effected in lower utility consumption required for operating the process, which may appear in the form of reduced power requirements for compression or re-compression, reduced power requirements for external refrigeration, reduced energy requirements for supplemental heating, or a combination thereof.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. A process for the separation of a gas stream, containing methane and components more volatile than methane, $C_2$ components, $C_3$ components, and heavier hydrocarbon components, into (i) a volatile residue gas fraction containing a major portion of said methane and components more volatile than methane and (ii) a relatively less volatile fraction containing a major portion of said $C_2$ components, $C_3$ components, and heavier hydrocarbon components wherein (1) said gas stream is cooled under pressure sufficiently to form a partially condensed gas stream;

(2) said partially condensed gas stream is separated thereby to provide a vapor stream and at least one liquid stream;

(3) said vapor stream in its entirety is expanded to a lower pressure to form an expanded vapor stream, whereupon said expanded vapor stream is supplied to a distillation column at a mid-column feed position;

(4) said at least one liquid stream is further cooled to form a cooled liquid stream;

(5) said cooled liquid stream is divided into first and second portions;

(6) said first portion is expanded to said lower pressure to form an expanded first portion;

(7) said expanded first portion is heated to form a heated expanded first portion, thereby to supply at least a portion of the cooling of step (4), whereupon said heated expanded first portion is supplied to said distillation column at a lower mid-column feed position below said mid-column feed position;

(8) said second portion is further cooled to form a cooled second portion;

(9) said cooled second portion is expanded to said lower pressure to form an expanded cooled second portion, whereupon said expanded cooled second portion is supplied to said distillation column at a top feed position;

(10) said expanded cooled second portion, said expanded vapor stream, and said heated expanded first portion are fractionated in said distillation column at said lower pressure to form a distillation vapor stream and said relatively less volatile fraction;

(11) said distillation vapor stream is heated to form said volatile residue gas fraction, thereby to supply at least a portion of the cooling of step (8); and

(12) the quantities and temperatures of said expanded cooled second portion, said expanded vapor stream, and said heated expanded first portion are effective to maintain the overhead temperature of said distillation column at a temperature whereby the major portion of said $C_2$ components, $C_3$ components, and heavier hydrocarbon components is recovered in said relatively less volatile fraction.

2. The process according to claim 1 wherein said distillation column comprises an absorber column and a stripper column, wherein (a) said expanded vapor stream is supplied at a first lower column feed position to said absorber column that produces said distillation vapor stream and a bottom liquid stream, whereupon said bottom liquid stream is supplied to said stripper column at a top feed position of said stripper column;

(b) an overhead vapor stream is withdrawn from an upper region of said stripper column and is supplied to said absorber column at a second lower column feed position;

(c) said expanded cooled second portion is supplied to said absorber column at a top feed position; and (d) the quantities and temperatures of said expanded cooled second portion and said expanded vapor stream are effective to maintain the overhead temperature of said absorber column at a temperature whereby the major portion of said $C_2$ components, $C_3$ components, and heavier hydrocarbon components is recovered in said relatively less volatile fraction.

3. An apparatus for the separation of a gas stream, containing methane and components more volatile than methane, $C_2$ components, $C_3$ components, and heavier hydrocarbon components, into (i) a volatile residue gas fraction containing a major portion of said methane and components more volatile than methane and (ii) a relatively less volatile fraction containing a major portion of said $C_2$ components, $C_3$ components, and heavier hydrocarbon components comprising (1) one or more inlet gas heat exchangers that are connected to receive said gas stream and cool said gas stream under pressure sufficiently to form a partially condensed gas stream;

(2) a separator connected to said one or more inlet gas heat exchangers to receive said partially condensed gas stream and separate said partially condensed gas stream into a vapor stream and at least one liquid stream;

(3) an expander connected to said separator to receive said vapor stream in its entirety and expand said vapor stream to lower pressure to form an expanded vapor stream;

(4) a distillation column connected to said expander to receive said expanded vapor stream at a mid-column feed position;

(5) a first heat exchanger connected to said separator to receive said at least one liquid stream and further cool said at least one liquid stream to form a cooled liquid stream;

(6) a divider connected to said first heat exchanger to receive said cooled liquid stream and divide said cooled liquid stream into first and second portions;

(7) a first expansion valve connected to said divider to receive said first portion and expand said first portion to said lower pressure to form an expanded first portion;

(8) said first heat exchanger further connected to said first expansion valve to receive said expanded first portion and heat said expanded first portion to form a heated expanded first portion, thereby to supply at least a portion of the cooling of step (5), said first heat exchanger being further connected to said distillation column to supply said heated expanded first portion to said distillation column at a lower mid-column feed position below said mid-column feed position;

(9) a second heat exchanger connected to said divider to receive said second portion and further cool said second portion to form a cooled second portion;

(10) a second expansion valve connected to said second heat exchanger to receive said cooled second portion and expand said cooled second portion to said lower pressure to form an expanded cooled second portion, said second expansion valve being further connected to said distillation column to supply said expanded cooled second portion to said distillation column at a top feed position;

(11) said distillation column adapted to fractionate said expanded cooled second portion, said expanded vapor stream, and said heated expanded first portion at said lower pressure to form a distillation vapor stream and said relatively less volatile fraction; and

(12) said second heat exchanger further connected to said distillation column to receive said distillation vapor stream and heat said distillation vapor stream to form said volatile residue gas fraction, thereby to supply at least a portion of the cooling of step (9).

4. The apparatus according to claim 3 wherein said distillation column comprises an absorber column and a stripper column, wherein (a) said expander is connected to said absorber column to supply said expanded vapor stream to said absorber column at a first lower column feed position, said absorber column being adapted to produce said distillation vapor stream and a bottom liquid stream;

(b) said stripper column is connected to said absorber column to receive said bottom liquid stream at a top feed position of said stripper column, said stripper column being adapted to fractionate said bottom liquid stream into an overhead vapor stream and said relatively less volatile fraction;

(c) said absorber column is further connected to said stripper column to receive said overhead vapor stream at a second lower column feed position; and (d) said absorber column is further connected to said second expansion valve to receive said expanded cooled second portion and supply said expanded cooled second portion to said absorber column at a top feed position.

* * * * *